US005566489A

United States Patent [19]

Artman et al.

[11] Patent Number: 5,566,489

[45] Date of Patent: Oct. 22, 1996

[54] OVER-BARREL FLASH GUARD FOR USE WITH A MUZZLE-LOADING FIREARM

[76] Inventors: Gary F. Artman; Ronnie G. Artman, both of R.D. #1, Box 8, Hartstown, Pa. 16131

[21] Appl. No.: 440,485

[22] Filed: May 12, 1995

[51] Int. Cl.[6] ..... F41A 35/00; F41H 5/12

[52] U.S. Cl. ..... 42/83; 42/90; 89/36.06

[58] Field of Search ..... 42/83, 90, 100, 42/106, 53; 89/36.06

[56] References Cited

U.S. PATENT DOCUMENTS

| | | | |
|---|---|---|---|
| 964,570 | 7/1910 | Singer | 42/106 |
| 1,273,025 | 7/1918 | Brongel | 42/53 |
| 1,307,441 | 6/1919 | Frensdorf | 42/100 |
| 1,320,888 | 11/1919 | Miller et al. | 42/106 |
| 1,555,027 | 9/1925 | Rose | 89/36.06 |
| 2,306,708 | 12/1942 | Mendel | 42/106 |
| 2,795,048 | 6/1957 | Seymour et al. | 42/100 |
| 4,815,822 | 3/1989 | Bramhall | 42/100 |

FOREIGN PATENT DOCUMENTS

| | | | |
|---|---|---|---|
| 22767 | 4/1915 | United Kingdom | 89/36.06 |

*Primary Examiner*—Michael J. Carone
*Assistant Examiner*—Theresa M. Wesson

[57] ABSTRACT

An over-barrel flash guard for use with a muzzle-loading firearm including a plate having a front surface, a back surface, and a periphery interconnecting the surfaces formed of an upper edge, a lower edge, a vertical long side edge, and a vertical short side edge with the side edges interconnected between the upper edge and the lower edge and with the plate further having a notch formed on the lower edge and wherein the notch has a narrow upper part and a wide lower part and wherein the lower part of the notch defines a holding space for removably holding a stock of a muzzle-loading firearm at a location near a flintlock thereof and the upper part of the notch defines a sighting window aligned with a sight on the barrel of the muzzle-loading firearm.

6 Claims, 3 Drawing Sheets

FIG. 1
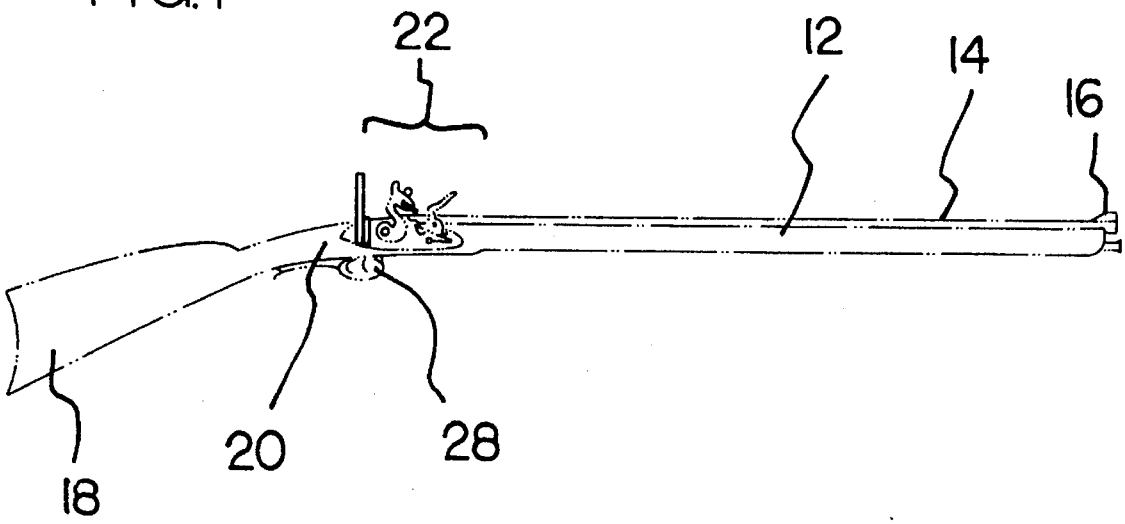
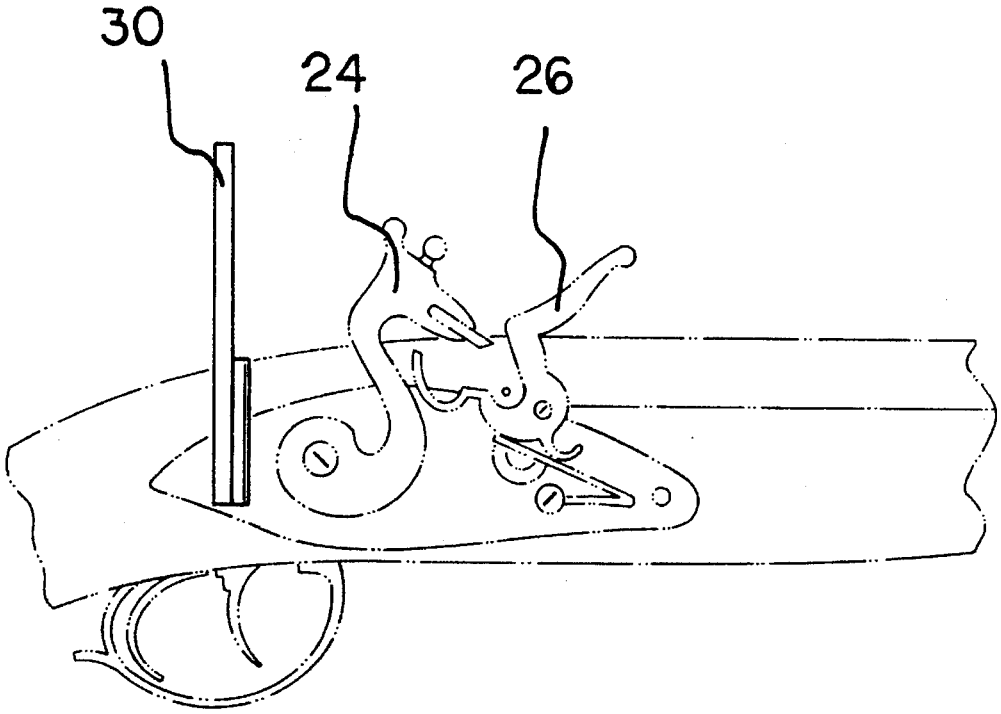
FIG. 2

OVER-BARREL FLASH GUARD FOR USE WITH A MUZZLE-LOADING FIREARM

BACKGROUND OF THE INVENTION

1. Field of the Invention

The present invention relates to an over-barrel flash guard for use with a muzzle-loading firearm and more particularly pertains to protecting a user from back blast of powder flash when a muzzle-loading firearm is fired with an over-barrel flash guard for use with a muzzle-loading firearm.

2. Description of the Prior Art

The use of weapon flash guards is known in the prior art. More specifically, weapon flash guards heretofore devised and utilized for the purpose of minimizing back blast of powder flash when a weapon is fired are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,451,154 to Goble discloses safety mechanisms for firearms. U.S. Pat. No. 3,985,594 to Bjorn discloses a method of reducing the muzzle flash when firing fire arms loaded with powder, and powder flash-reducing agent intended for this purpose. U.S. Pat. No. 4,485,577 to Lunders discloses a cap cover for percussion fire arms. U.S. Pat. No. 4,700,499 to Knight discloses a muzzle-loading rifle. U.S. Pat. No. 4,989,357 to Norman et al. discloses a muzzle loader safety. U.S. Pat. No. 5,339,553 to Kearns discloses a self-removing cover for percussion type fire arms.

While these devices fulfill their respective, particular objective and requirements, the aforementioned patents do not describe an over-barrel flash guard for use with a muzzle-loading firearm that protects a user's face and eyes from back blast due to firing of a muzzle-loading weapon.

In this respect, the over-barrel flash guard for use with a muzzle-loading firearms according to the present invention substantially departs from the conventional concepts and designs of the prior art, and in doing so provides an apparatus primarily developed for the purpose of protecting a user from back blast of powder flash when the muzzle-loading firearm is fired.

Therefore, it can be appreciated that there exists a continuing need for new and improved over-barrel flash guard for use with a muzzle-loading firearm which can be used for protecting a user from back blast of powder flash when the muzzle-loading firearm is fired. In this regard, the present invention substantially fulfills this need.

SUMMARY OF THE INVENTION

In the view of the foregoing disadvantages inherent in the known types of weapon flash guards now present in the prior art, the present invention provides an improved over-barrel flash guard for use with a muzzle-loading firearm. As such, the general purpose of the present invention, which will be described subsequently in greater detail, is to provide a new and improved over-barrel flash guard for use with a muzzle-loading firearm and method which has all the advantages of the prior art and none of the disadvantages.

To attain this, the present invention essentially comprises, in combination, a muzzle loading firearm having a barrel with a sight formed on an outboard extent thereof, a butt, a stock extended therebetween with a characteristic width of about 1 6/16 inches, an actuatable flintlock operatively coupled to the barrel and projected outwards from the stock, and a trigger operatively coupled to the flintlock for allowing its actuation.

A rigid plastic plate is provided. The plate has a planar front surface, an opposed planar back surface, and a periphery interconnecting the surfaces formed of an upper edge, a lower edge, a vertical long side edge, and a vertical short side edge and with the side edges interconnected between the upper edge and the lower edge. The plate further has a notch formed on the lower edge and wherein the notch has a narrow upper part with a horizontal width that is less than the characteristic width or about 7/16 inch, a wide lower part with a horizontal width that is approximately equal to the characteristic width, and a height that is greater than the characteristic width or about 1 3/16 inches, and wherein the lower part of the notch defines a holding space. The stock of the firearm is removably held within the holding space with the plate positioned at a location adjacent to the flintlock and above the trigger of a muzzle-loading firearm. The upper part of the notch defines a sighting window that is aligned with the sight on the firearm. The long side edge of the plate has a length that is greater than the characteristic width or about 3 inches, and the short side edge of the plate has a length of about 2 5/16 inches.

The upper edge of the plate is further formed of a horizontal upper long portion extended from the long side edge, a horizontal upper short portion extended from the short side edge, and a vertical upper cross portion interconnecting the upper long portion with the upper short portion to define a back blast blocking area. The upper long portion has a length of about 1 13/16 inches. The upper short portion has a length of about 1½ inches. The upper cross portion has a length of about 11/16 inch.

The lower edge of the plate is further formed of a horizontal lower long portion extended from the long edge, a horizontal lower short portion extended from the short edge, and central portion bounding the notch. The central portion is further formed of a pair of spaced vertical long lower edge extents, a pair of spaced vertical short upper edge extents, a horizontal lower long cross edge extent extended between one of the vertical long lower edge extents and the adjacently located vertical short upper edge extent, a horizontal lower short cross edge extent extended between the other vertical long lower edge extent and the other vertical short upper edge extent, and a horizontal upper cross edge extent extended between the pair of vertical short upper edge extents. The lower long portion has a length of about 1¼ inches. The lower short portion has a length of about 7/16 inch. The long lower edge extents each have a length of about 1 inch. The short upper edge extents each have a length of about 9/16 inch. The lower long cross edge extent has a length of about ½ inch. The lower short cross edge extent has a length of about 7/16 inch. The upper cross edge extent has a length of about 7/16 inch.

Lastly, a pair of elongated flanges is provided. Each flange is coupled to and extended outwards from the front surface of the plate at a location adjacent to one of the long lower edge extents thereof. The flanges facilitate correct positioning and securement of the plate with respect to the firearm. Each flange has a height of about 1 inch and a thickness of about ⅛ inch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved over-barrel flash guard for use with a muzzle-loading firearm which has all the advantages of the prior art weapon flash guards and none of the disadvantages.

It is another object of the present invention to provide a new and improved over-barrel flash guard for use with a muzzle-loading firearm which may be easily and efficiently manufactured and marketed.

It is a further object of the present invention to provide a new and improved over-barrel flash guard for use with a muzzle-loading firearm which is of durable and reliable construction.

An even further object of the present invention is to provide a new and improved over-barrel flash guard for use with a muzzle-loading firearm which is susceptible of a low cost of manufacture with regard to both materials and labor, and which accordingly is then susceptible of low prices of sale to the consuming public, thereby making such a over-barrel flash guard for use with a muzzle-loading firearm economically available to the buying public.

Still yet another object of the present invention is to provide a new and improved over-barrel flash guard for use with a muzzle-loading firearm which provides in the apparatuses and methods of the prior art some of the advantages thereof, while simultaneously overcoming some of the disadvantages normally associated therewith.

Even still another object of the present invention is to provide a new and improved over-barrel flash guard for use with a muzzle-loading firearm for protecting a user from back blast of powder flash when the muzzle-loading firearm is fired.

Lastly, it is an object of the present invention to provide a new and improved over-barrel flash guard for use with a muzzle-loading firearm comprising a plate having a front surface, a back surface, and a periphery interconnecting the surfaces formed of an upper edge, a lower edge, a vertical long side edge, and a vertical short side edge and with the side edges interconnected between the upper edge and the lower edge, the plate further having a notch formed on the lower edge and wherein the notch has a narrow upper part and a wide lower part and wherein the lower part of the notch defines a holding space for removably holding a stock of a muzzle-loading firearm at a location near a flintlock thereof and the upper part of the notch defines a sighting window aligned with a sight on the barrel of the muzzle-loading firearm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment constructed in accordance with the principles of the present invention secured to a muzzle-loading firearm.

FIG. 2 is an enlarged fragmentary side elevational view of the coupling of the plate to the rifle as shown in FIG. 1.

The same reference numerals refer to the same parts through the various Figures.

DESCRIPTION OF THE PREFERRED EMBODIMENT

Figure 3:
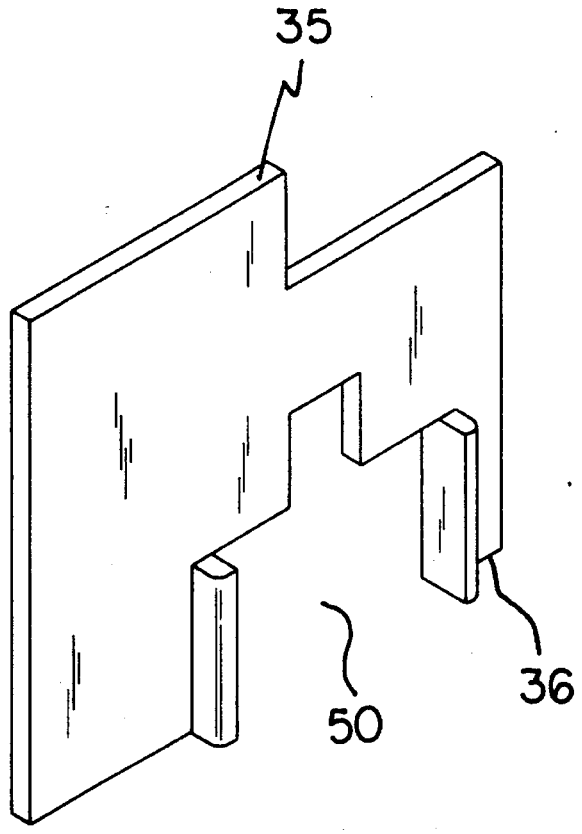
FIG. 3 is a perspective view of the present invention when removed from a muzzle loading firearm.

With reference now to the drawings, and in particular, to FIG. 1 thereof, the preferred embodiment of the new and improved over-barrel flash guard for use with a muzzle-loading firearm embodying the principles and concepts of the present invention will be described.

The present invention is specifically structured for use with a muzzle loading firearm 12 as shown in FIG. 1. The muzzle loading firearm has a barrel 14 with a sight 16 formed on an outboard extent thereof. The sight allows the barrel to be aligned correctly when firing. The firearm also includes a butt 18 and a stock 20 extended between the butt and barrel 14. The stock has a characteristic width. Preferably, in the preferred embodiment, the characteristic width of the stock is about and 1 9/16 inches. The muzzle loading firearm also includes an actuatable flintlock 22 operatively coupled to the barrel for effecting firing action. The flintlock includes a hammer 24 and a powder holder 26. The flintlock is projected outwards from either the right side or the left side of the stock. A trigger 28 is operatively coupled to the flintlock for allowing its actuation for firing.

Figure 4:
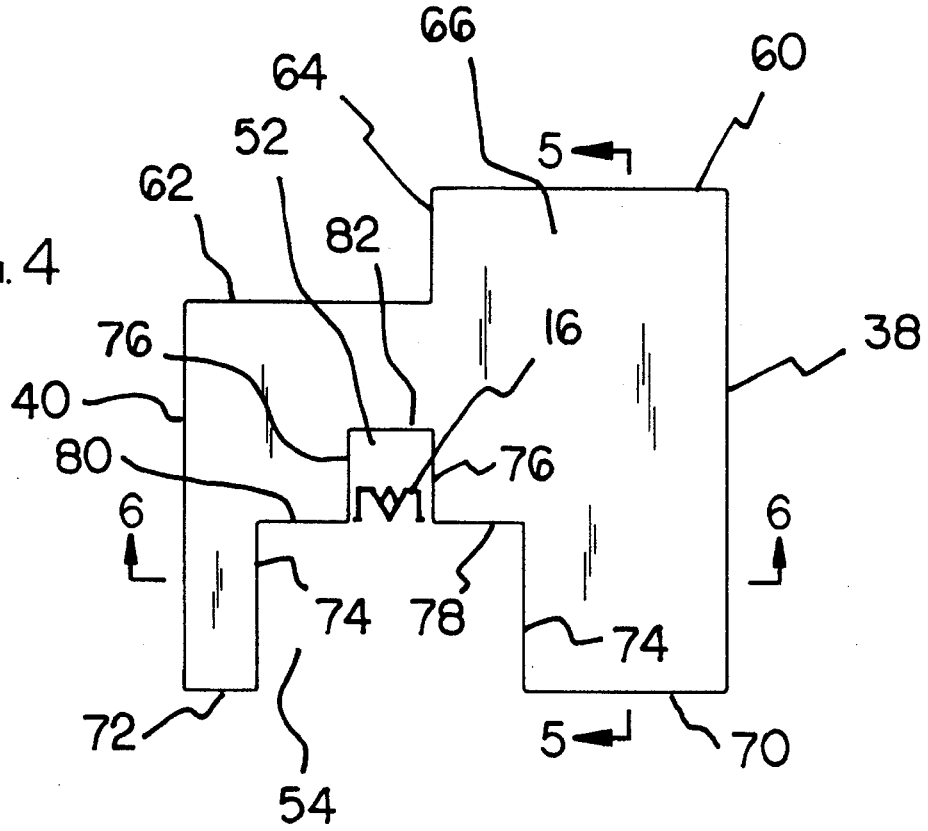
FIG. 4 is a side elevational view of the present invention.

Specifically, the present invention includes a plate 30. The plate is rigid in structure and formed of plastic or metal. The plate has a planar front surface 32, and opposed planar back surface 34, and a periphery 35 interconnecting the surfaces. The periphery is formed of an upper edge 34, a lower edge 36, a vertical long side edge 38, and a vertical short side edge 40 as shown in FIG. 3. The side edges 38, 40 are interconnected between the upper edge 34 and the lower edge 36. The plate also includes a notch 50 formed thereon at the lower edge. The notch has a narrow upper part 52 that is generally rectangular in structure and a wide lower part 54 that is also generally rectangular in structure. The upper part of the notch has a width that is less than the characteristic width of the stock. Preferably, the width of the upper part is about 7/16 inch. The lower part of the notch has a width that is approximately equal to the characteristic width of the stock. Preferably, the width of the lower part is about 1 9/16 inches. The notch also has a height that is greater than the characteristic width. Preferably, the height of the notch is about 1 3/16 inches. The lower part of the notch defines a holding space. The stock 20 of the firearm frictionally removably held by the plate within the holding space at a location adjacent to and rearwardly of the flintlock 22 and above the trigger 28. When the firearm is secured with the plate in this manner, the plate is held in a near perpendicular orientation with respect to the barrel 14. The upper part of the notch defines an open sighting window. The sighting window is aligned with the sight 16 on the barrel of the firearm as shown in FIG. 4. The long side edge of the plate has a length that is greater than the width of the stock. Preferably, the length of the long side edge is about 3 inches. The short side edge of the plate has a length of about 2 5/16 inches.

The upper edge of the plate is further formed of a horizontal upper long portion 60 interconnected with and extended from the long side edge 38, a horizontal upper short portion 62 interconnected with and extended from the short side edge 40, and a vertical upper cross portion 64 interconnected between the upper long portion and the upper short portion to thereby define a back blast blocking area 66. A back blast blocking area 66 is positioned rearwardly of the hammer portion 24 of the flintlock. The blocking area stops blast powder and flint chips from being projected rearwardly when the flint lock is actuated by a user. The sighting window 52 facilitates ease of aiming of the rifle 12 when the back blast area positioned in an operable location on the stock. The upper long portion has a length of about 1 3/16 inches. The upper short portion has a length of about 1½ inches. The upper cross portion has a length of about 11/16 inches.

The lower edge is further formed of a horizontal lower long portion 70 interconnected with and extended from the long edge 38, a horizontal lower short portion 72 interconnected with and extended from the short edge 40, and a central portion bounding the notch 50. The central portion is further formed of a pair of spaced and vertical long lower edge extents 72, a pair of spaced and vertical short upper edge extents 76, a horizontal lower long cross edge extent 78 extended between one of the vertical long lower edge extents and the adjacently located vertical short upper edge extent, a horizontal lower short cross edge extent 80 extended between the other vertical long lower edge extent and the other adjacently located vertical short upper edge extent, and a horizontal upper cross edge extent 82 extended between the pair of vertical short upper edge extents. See FIG. 4. The lower short portion has length of about 11/16 inch. The long lower edge extents each have a length of about 1 inch. The short upper edge extents each have a length of about 9/16 inch. The lower long cross edge extent has a length of about ½ inch. The lower short cross edge extent has a length of about 7/16 inch. Lastly, the upper cross edge extent has a length of about 7/16 inch.

Figure 5:
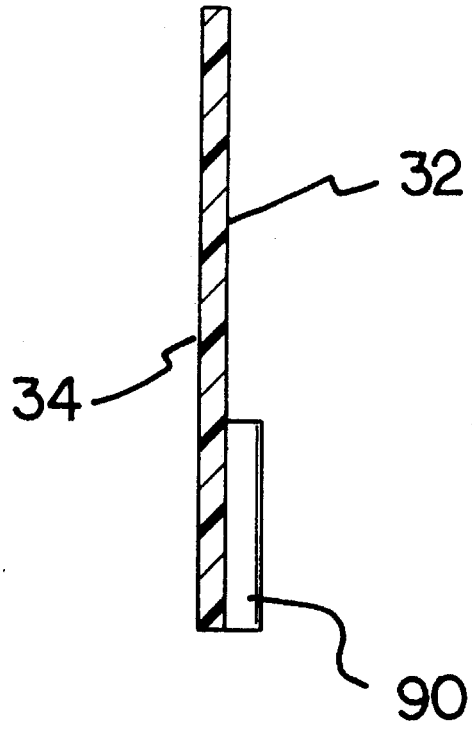
FIG. 5 is a cross-sectional view of the present invention taken along the line 5—5 of FIG. 4.
Figure 6:
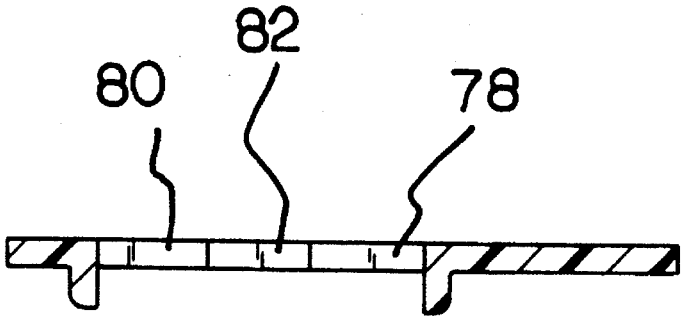
FIG. 6 is a cross-sectional view of the present invention taken along the line 6—6 of FIG. 4.

As best illustrated in FIGS. 3 and 5, a pair of elongated flanges 90 are included. Each flange is coupled to and extended outwards from the front surface of the plate at a location adjacent to one of the long lower edge extents 94. The flanges facilitate correct positioning and securement of the plate with respect to the firearm 12. Each flange can be formed of a rigid material or an elastomeric material. Each flange has a height of about 1 inch and thickness of about ⅛ inch.

The present invention is a plastic device which attaches to all muzzle-loading fire arms. The present invention cuts down on powder flash and prevents a user from jerking away from powder flash when a muzzle-loading firearm is fired. The present invention attaches to the flintlock or hammer side of the firearm. It covers the flintlock including the hammer and powder holder. The present invention offers eye protection and face protection from powder flash, flaring flint chips, and powder residue. The present invention is designed for left-handed and right-handed muzzle-loading firearms and can be emplaced on either type of firearm by simply rotating the plate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An over-barrel flash guard for use with a muzzle-loading firearm for protecting a user from back blast of powder flash when the muzzle-loading firearm is fired comprising, in combination:

a muzzle loading firearm having a barrel with a sight formed on an outboard extent thereof, a butt, a stock extended therebetween and having a characteristic width of about 1 9/16 inches, an actuatable flintlock operatively coupled to the barrel and projected outwards from the stock, and a trigger operatively coupled to the flintlock for allowing its actuation;

a rigid plastic plate having a planar front surface, an opposed planar back surface, and a periphery interconnecting the surfaces formed of an upper edge, a lower edge, a vertical long side edge, and a vertical short side edge and with the side edges interconnected between the upper edge and the lower edge, the plate further having a notch formed on the lower edge and wherein the notch has a narrow upper part with a horizontal width that is about 7/16 inch, a wide lower part with a horizontal width that is approximately equal to the characteristic width, and a height that is about 1 3/16 inches, and wherein the lower part of the notch defines a holding space with the stock of the firearm removably held therein at a location adjacent to the flintlock and above the trigger and the upper part of the notch defines a sighting window aligned with the sight on the firearm, and wherein the long side edge has a length that is about 3 inches and the short side edge has a length of about 2 5/16 inches, the upper edge further formed of a horizontal upper long portion extended from the long side edge, a horizontal upper short portion extended from the short side edge, and a vertical upper cross portion interconnecting the upper long portion with the upper short portion to define a back blast blocking area and wherein the upper long portion has a length of about 1 13/16 inches, the upper short portion has a length of about 1½ inches, and the upper cross portion has a length of about 11/16 inch, the lower edge further formed of a horizontal lower long portion extended from the long edge, a horizontal lower short portion extended from the short edge, and central portion bounding the notch and with the central portion further formed of a pair of spaced vertical long lower edge extents, a pair of spaced vertical short upper edge extents, a horizontal lower long cross edge extent extended between one of the vertical long lower edge extents and the adjacently located vertical short upper edge extent, a horizontal lower short cross edge extent extended between the other vertical long lower edge extent and the other vertical short upper edge extent, and a horizontal upper cross edge extent extended between the pair of vertical short upper edge extents, and wherein the lower long portion has a length of about 1¼ inches, the lower short portion has a length of about 7/16 inch, the long lower edge extents each have a length of about 1 inch, the short upper edge extents each have a length of about 9/16 inch, the lower long cross edge extent has a length of about ½ inch, the lower short cross edge extent has a length of about 7/16 inch, and the upper cross edge extent has a length of about 7/16 inch; and a pair of elongated flanges with each flange coupled to and extended outwards from the front surface of the plate at a location adjacent to one of the long lower edge extents thereof and with the flanges facilitating correct positioning and securement of the plate with respect to the firearm and wherein each flange has a height of about 1 inch and a thickness of about ⅛ inch.

2. An over-barrel flash guard for use with a muzzle-loading firearm comprising:

a plate having a front surface, a back surface, and a periphery interconnecting the surfaces formed of an upper edge, a lower edge, a vertical long side edge, and a vertical short side edge and with the side edges interconnected between the upper edge and the lower edge, the plate further having a notch formed on the lower edge and wherein the notch has a narrow upper part and a wide lower part and wherein the lower part of the notch defines a holding space for removably holding a stock of a muzzle-loading firearm at a location near a flintlock thereof and the upper part of the notch defines a sighting window aligned with a sight on the barrel of the muzzle-loading firearm.

3. The over-barrel flash guard as set forth in claim 2 further comprising a muzzle loading firearm having a barrel with a sight formed on an outboard extent thereof, a butt, a stock extended therebetween, an actuatable flintlock operatively coupled to the barrel and projected outwards from the stock, and a trigger operatively coupled to the flintlock for allowing its actuation.

4. The over-barrel flash guard as set forth in claim 2 wherein a portion of the upper edge is extended upwards to form an extended back blast blocking area on the plate.

5. The over-barrel flash guard as set forth in claim 2 wherein:

the plate has horizontal width of 3 5/16;

the plate has a height of about 3 inches; and the lower part of the notch has a horizontal width of about 1 6/16 inches.

6. The over-barrel flash guard as set forth in claim 2 and further comprising a pair of elongated flanges with each flange coupled to and extended outwards from the plate on each side of the holding space.

* * * * *